United States Patent [19]

Wade

[11] 3,935,657

[45] Feb. 3, 1976

[54] RIFLE REST

[76] Inventor: Virdell H. Wade, Rte. 2, Box 116 B, Chandler, Ariz. 85224

[22] Filed: July 3, 1974

[21] Appl. No.: 485,512

[52] U.S. Cl. ..... 42/94

[51] Int. Cl.[2] ..... F41C 29/00

[58] Field of Search ..... 42/94; 89/37 B, 37 BA

[56] References Cited

UNITED STATES PATENTS

| | | | |
|---|---|---|---|
| 577,026 | 2/1897 | Heinrich | 89/37 BA |
| 2,774,563 | 12/1956 | Pribis | 89/37 BA |
| 2,877,689 | 3/1959 | Pribis | 89/37 BA |
| 3,012,350 | 12/1961 | Wold | 42/94 |
| 3,041,938 | 7/1962 | Seabrook | 42/94 |
| 3,703,046 | 11/1972 | Barone et al. | 42/94 |

*Primary Examiner*—Samuel Feinberg
*Assistant Examiner*—C. T. Jordan
*Attorney, Agent, or Firm*—H. Gordon Shields

[57] ABSTRACT

Apparatus is disclosed for receiving and resting a rifle for target shooting and the like in which the position or orientation of the rest may be adjusted for elevation.

6 Claims, 8 Drawing Figures

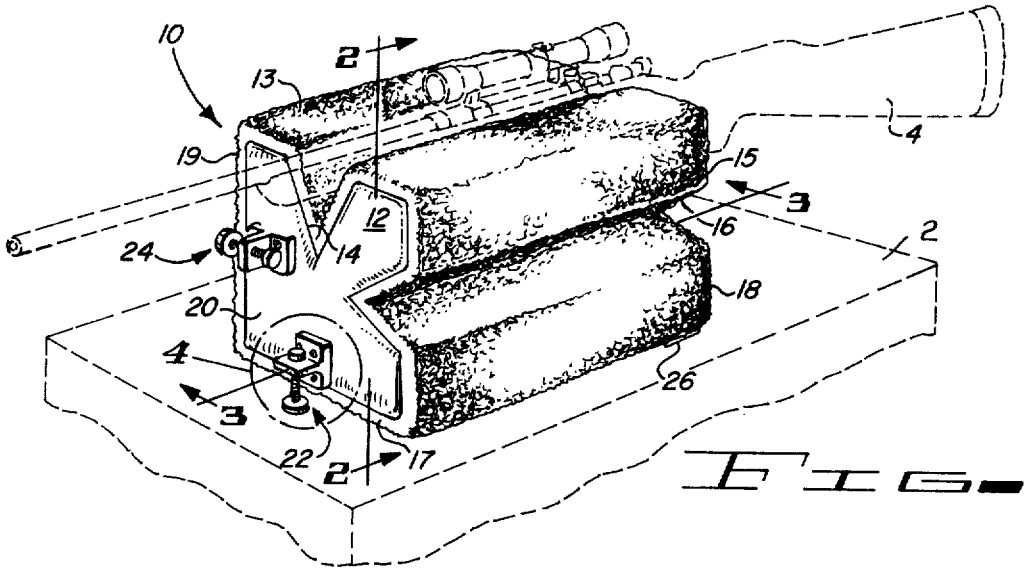
FIG-1
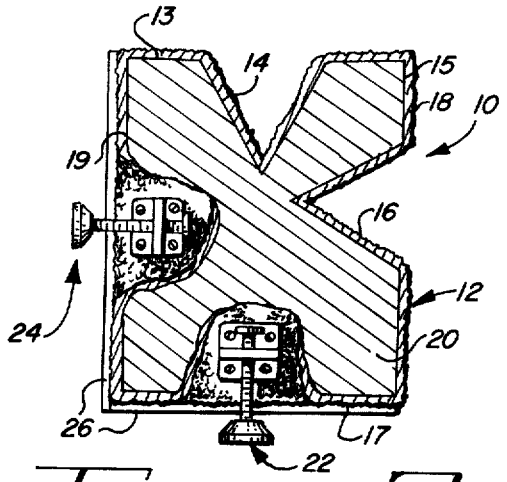
FIG-2
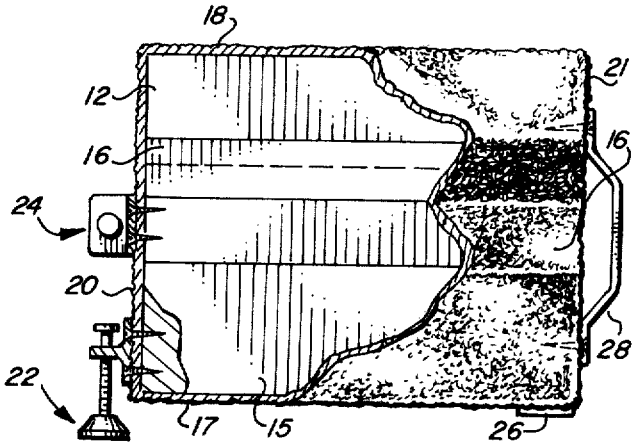
FIG-3
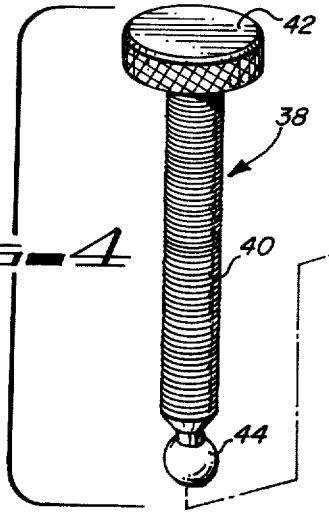
FIG-4
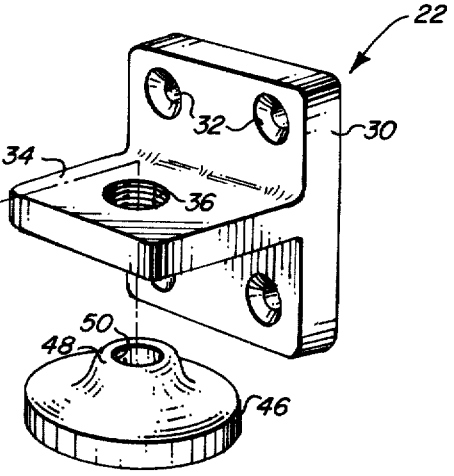

RIFLE REST

BACKGROUND OF THE INVENTION

1. Field of the Invention

This invention relates to rifle rests, and more particularly, to an adjustable rifle rest for use in target shooting and the like.

2. Description of the Prior Art

With respect to the prior art, the best known rifle rest is simply a bag of sand. The sand bag is placed on a table or on the ground, and a rifle is placed thereon. A rifle placed on a sand bag will normally contact the sand bag over a very limited portion of the rifle, but may contact the rifle over a variable area, depending on the orientation of the rifle on the sand bag. However, the rifle will be only disposed on the sand bag, and will not be in any way cradled by the sand bag. The result of this is that the rifle must be shouldered by the user of the rifle. That is, the rifle only rests on the sand bag and the individual user of the rifle must hold the rifle tightly against his shoulder. This can be accomplished only by pulling the rifle to his shoulder since there will be no resistance on the sand bag to the movement of the rifle thereon away from the user as the user leans against the rifle.

There are other numerous designs of rifle rests in the prior art, all of which are limited in the same way that the sand bag is, in that they present no resistance to the movement of the rifle. Most of the rifle rests of the prior art support the rifle only over a very limited portion of the rifle. In this manner, the rifle rests of the prior art generally provide dual functions: they provide support for the rifle and they act as a fulcrum or pivot for movement of the rifle. Again, they all have substantially severe limitations in that they require the user to pull the rifle, supported on the rests, to the user's shoulder.

Since prior art rifle rests generally provide only vertical support for a rifle over a small area of the rifle, they are not of much help in the actual aiming of the rifle. That is, the user of the rifle and the rest must move the rifle up and down, as well as sideways, in order to fire the rifle. The rifle pivots on the rifle rest or support and it will not maintain a fixed orientation thereon because the rifle is not supported over a substantial length.

Because the prior art rifle rests do not support the rifles over a substantial portion or length of the rifle, the rifles must be physically pulled toward the shoulder of the user of the rifle and the rest. This is necessary in order for the rifle to maintain its position or orientation on the support. A preferable situation is where the user of the rifle and support can "lean into" the rifle, with the rest providing substantial support for the rifle and also providing resistance to the forward movement of the rifle. In such a situation, there is sufficient friction between the rifle, the rest, and the table or platform on which the rest is disposed, to allow the user of the rifle and the rest to orient himself with respect to the rifle in a manner most comfortable and most convenient to the firing of the rifle. This is in contrast to the situation in which the typical prior art rifle rest provides only vertical support for the rifle over a limited length of the rifle so as to allow the rifle to pivot on the rest and to accordingly provide no stability for the rifle other than vertical support over a very limited area or portion of the rifle, and the user must provide the stability for the orientation of the rifle by pulling the rifle to him. Obviously, where the rifle rest is providing adequate support for the rifle, and the user may be oriented or situated in the most comfortable manner, the accuracy of the firings of the rifle will be greatly enhanced.

SUMMARY OF THE INVENTION

The invention described and claimed herein comprises a rifle rest block, having a pair of support grooves for a rifle, each of which is at a different level with respect to a platform or table upon which the rest may be disposed, to allow the user a choice of comfortable heights for the disposition of the rifle. The rifle rest also includes means for adjusting the elevation of the rifle rest and accordingly of the rifle disposed thereon.

Among the objects of the present invention are the following:

To provide new and useful rifle rest apparatus;

To provide new and useful apparatus for supporting a rifle;

To provide new and useful apparatus for supporting a rifle over a substantial length of the rifle;

To provide new and useful adjustable apparatus for supporting a rifle;

To provide new and useful apparatus for frictionally engaging a rifle disposed thereon; and To provide new and useful apparatus for supporting a rifle having a plurality of means for orienting and supporting a rifle.

BRIEF DESCRIPTION OF THE DRAWING

FIG. 1 is an isometric view of rifle rest apparatus embodying the present invention.

FIG. 2 is a view in partial section of the apparatus of FIG. 1 taken generally along line 2—2 of FIG. 1.

FIG. 3 is a view in partial section and partially broken away of the apparatus of FIG. 1 taken generally along line 3—3 of FIG. 1.

FIG. 4 is an exploded view of a portion of the apparatus of FIG. 1 enlarged from the circle 4 of FIG. 1.

DESCRIPTION OF THE PREFERRED EMBODIMENT

Figure 5:
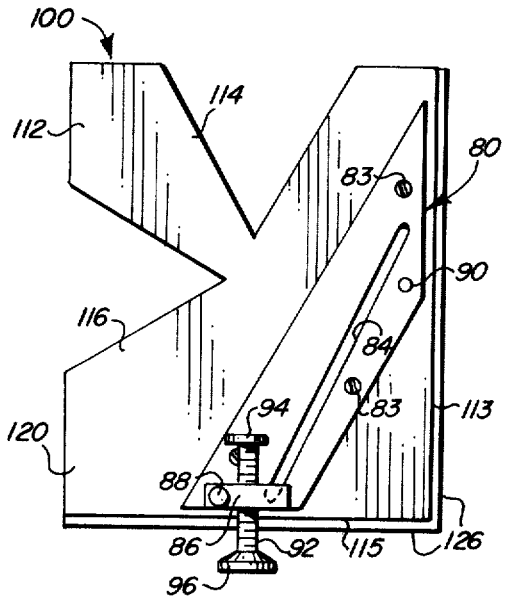
FIG. 5 is a view of the apparatus of the present invention illustrating in alternate embodiment of adjustment means for the apparatus.

FIG. 1 is an isometric view of rifle rest apparatus 10 comprising the present invention disposed on a platform or table 2, shown in phantom, and with a rifle 4, also shown in phantom, disposed on the apparatus 10.

The rifle rest apparatus 10 comprises an elongated block 12, which is a rectangular block, with opposite sides parallel, and with a pair of Vee notches or grooves 14 and 16 cut into a pair of adjacent sides 13 and 15 of the block 12, respectively, and extending along the block the length of the block, which comprises the longest or greatest dimension of the block. The notches 14 and 16 extend downwardly from the surfaces of the sides of the block and are cut at a 60° angle. That is, the sides of the notches are at 60° to each other.

The block 12 comprises a solid block, preferably made out of wood, with a pair of ends, front end 20 and rear end 21 (See FIG. 3) and four sides, 13, 15, 17, and 19 (See also FIG. 2). Side 13 comprises the top, and side 17 comprises the bottom of the block. The four sides, including the two vee notches extending downwardly from the top surface of the sides 13 and 15, are completely covered with an appropriate covering 18, such as short shag carpeting. The carpeting covering 18 serves to protect and cushion a rifle disposed on the rifle rest and in each notch, and protect the rifle disposed therein from scratches. The length of the block 12, and accordingly of the vee notches 14 and 16, is sufficient to support a rifle disposed in the notches over a substantial length of the rifle, in order to allow the rifle to be free standing in the notch, and thus on the rifle rest apparatus, without the necessity of the user supporting the rifle. Typically, the length of the block 12 is about 12 inches.

The block 12, being rectangular in shape, is dimensioned with respect to width and height appropriately to allow a user to select the appropriate orientation of the block, with respect to width and height so as to allow the rifle to be disposed in the vee notch, which is most comfortable for him. Accordingly, the width of the block is typically about 6 inches, and the height of the block about 8 inches. This gives a difference of about two inches between the width and the height, which is sufficient for the comfort and convenience of different users. For example, if a relatively tall individual were to use the rifle rest, the rifle rest apparatus 10 would be oriented so that notch 14 would be disposed as shown in FIG. 1, which is the notch cut into the narrowest portion or width of the block, but on top of the longest dimension. If a shorter user were to use the rifle rest apparatus, the notch 16 would be disposed upwardly, with the short width of the block extending vertically. Thus notch 16 is cut into the long dimension of the block on side 15, which minimizes the distance between the vee and the table or platform upon which the rifle rest is disposed. Again, the two inch difference between the dimensions of the block is sufficient to compensate for the size differential of most shooters.

Upon the front end of the block 12, identified by reference numeral 20, is a pair of adjustment means 22 and 24. The adjustment means may be used to adjust the height of the block to aid in aiming the rifle disposed on the rifle rest apparatus. As illustrated in FIG. 1, with a rifle 4 supported over a substantial length of its stock in vee notch 14, adjustment means 22 may be used to adjust the height of the end 20 of the block. Accordingly, the barrel of the rifle 4 will be raised or lowered as desired. If a user were to select vee notch 16 on side 15 in which to dispose the stock of a rifle, the corresponding adjustment means 24 would be used to adjust the block and accordingly the rifle as desired by the user.

While the shag carpeting, preferably a long-lasting and durable material such as nylon, has substantial friction inherent in itself, it may be advantageous to increase the friction of the block by friction means 26 disposed on adjacent sides of the block opposite from the vee notches 14 and 16. The friction means 26, such as a strip of rubber or individual rubber feet, are disposed adjacent the opposite end of the block 12 from the end 20, on which the adjustment means 22 and 24 are disposed.

FIG. 2 is a view in partial section of the apparatus of FIG. 1, taken generally along line 2—2 of FIG. 1 and illustrating the orientation of the vee notches 14 and 16 in the apparatus 10 with respect to the adjustment means 22 and 24. The block 12 is shown with the covering 18 extending substantially completely around the exterior periphery of the block, or the external periphery of the sides of the block, as opposed to the ends of the block. The ends of the blocks, including end 20, need not be covered with the shag carpet covering 18, but may be covered with some other material, such as naugahide or the like, for esthetic purposes. The covering 18 has a functional purpose, as described above, but the same functional purpose would not apply to the ends.

In FIG. 2, the orientation of notches 14 and 16 is clearly indicated, with notch 14 cut into the narrower dimension of the block 12, defined as the width of the block. The vee notch or groove 14 thus extends into the block along the lower dimension of the block, defined as the height of the block. The vee notch or groove 16 is cut into the block from the longer dimension, or the height of the block, and thus extends into the block through the narrower dimension or the width of the block.

As shown in FIG. 2, a rifle stock may be laid in the notch or groove 14, to accommodate the needs or requirements of a particular shooter. If the shooter or user would prefer to have the rifle lower to a table or support upon which the rifle rest apparatus 10 is disposed, he would rotate the block 90° so that the vee notch or groove 16 would be disposed upwardly and a rifle stock could then be placed within the notch 14.

Friction means 26, such as a rubber strip, is disposed about two sides of the block 12 opposite the vee notches 14 and 16 and remote from, or at the opposite end of the block 12, from the adjustment means 22 and 24. The friction means are secured to sides 17 and 19.

If it is desired to elevate the end 20 of the block 12, and accordingly to elevate a rifle disposed in vee notch 14 of the rifle rest apparatus 10, adjustment means 22 are actuated to accomplish the desired raising. If the rifle rest apparatus 10 is disposed with vee notch 16 extending upwardly, then adjustment means 24 will be used to adjust the height of the end 20 of the block 12. For purposes of illustration herein, the end 20 will be designated hereafter as the front end of the block.

FIG. 3 is a view of the apparatus of FIG. 1 taken generally along line 3—3 of FIG. 1, and showing a side view of the rifle rest apparatus 10, partially broken away. The block 12 is shown with the notch 16 extending into the block. A dotted line is shown extending across the block 12 and the dotted line denotes the bottom of the vee notch 14. The covering 18, a shag carpeting, is shown disposed about the exterior periphery of the sides of the block 12. A strip of friction means 26 is disposed on what is shown as the bottom side 17 of the block 12 adjacent end 21, which is the end of the block opposite front end 20. The end 21 is considered the rear end of the block, as opposed to the front end 12.

Secured to the front end 20 of the block 12 are the adjustment means 22 and 24. With the rifle rest apparatus 10 disposed as shown, the front end 20 of the block 12 would be elevated from the back end or rear end 21. The adjustment means 22 may be varied to elevate the front end 20 of the block as desired by a user. If a rifle were to be disposed in notch 16 of the rifle rest apparatus 10 with the apparatus as shown in FIG. 3, a substantial portion of the stock of the rifle would be supported within the vee notch 16. With the trigger guard of the rifle adjacent the back or rear end 21 of the apparatus 10, the rifle is supported within the notch of the apparatus and is frictionally engaged therewith. That is, the friction of the shag carpet covering 18 against the stock of a rifle disposed in the groove 14 is sufficient to hold the rifle in the rifle rest apparatus. With the trigger guard against the rear end 21 of the block 12, there is sufficient friction between the rifle and the rifle rest, and between the rifle rest and any surface on which it is disposed, by virtue of the friction means 26 and the adjustment means 22, to prevent relative motion between the table or support for the rifle rest apparatus and between the rifle and the rifle rest apparatus. It is thus not necessary for a user of the apparatus to pull the rifle towards him to prevent the movement of the rifle and the rifle rest during use. A carrying strap 28 is shown secured to the rear end 21 of the block. Any appropriate carrying means may be used to conveniently carry the rifle rest.

FIG. 4 is an exploded view of a portion of the apparatus of FIGS. 1, 2, and 3, taken from the circle 4 of FIG. 1. It comprises an exploded and enlarged view of adjustment means 22.

The adjustment means 22, which is substantially identical to the adjustment means 24, includes a plate 30 which is secured to the end 20 of the block 12 by appropriate fastening means, such as screws extending through a plurality of apertures or holes 32. The apertures or holes 32 extend through the plate 30 and, as illustrated, there are four of them. A bracket 34 extends outwardly from the plate 30. The bracket 34 includes a tapped hole 36 extending therethrough. If the plate 30 were tipped or oriented such that the bracket 34 extended downwardly, the configuration of the plate and bracket would be that of a "tee", with the bracket 34 extending at substantially a right angle to the plate and from about the center thereof. For convenience, the plate and bracket may be made of any appropriate material, such as steel or aluminum. For ease of manufacturing, the plate and bracket may preferably be cast or machined from a single piece so that they are integral with each other. Alternatively, of course, the bracket may be welded to the plate.

A screw 38 is shown with connection lines extending between the screw and the tapped hole 36 to indicate that the screw is received by the tapped hole 36. The screw includes a threaded shank 40, the threads of which match the threads of the hole 36. On the top of the screw 38 is a narrow knob 42, integral with the threaded shank. At the bottom or lower end of the screw 38 is a ball 44, also integral with the threaded shank 40. In use, the screw 38 is threaded into the tapped hole 36 and adjusted therein.

A foot 46 is disposed beneath the plate 30 and it is secured to the screw 38 after the screw is threaded through the hole 36. The foot 46 includes a boss 48 extending upwardly and centrally of the foot. The boss includes a recess 50 extending downwardly from the top of the boss. The recess 50 receives the ball 44 of the screw 38 and is preferably peened over against the ball to secure the foot to the screw. With the foot secured to the screw, the engagement between the recess 50 of the boss 48 and the ball 44 is a sliding engagement so that the screw may be turned without a corresponding movement of the foot. In other words, the foot moves vertically with the screw, but the foot need not rotate as the screw is turned.

Frictional material, such as rubber, may be secured to the bottom of the foot to increase the friction between the rifle rest apparatus and the platform or table on which the apparatus is disposed.

Figure 6:
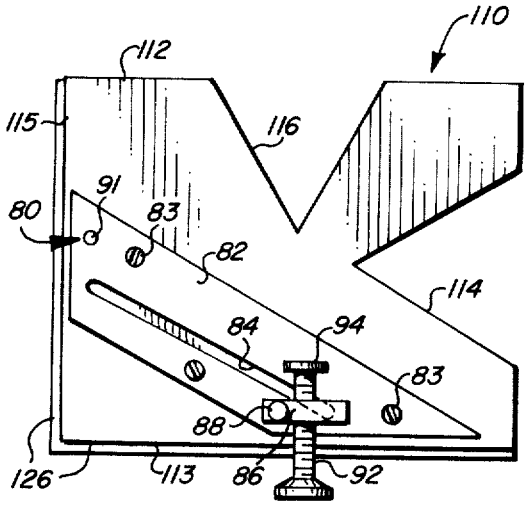
FIG. 6 is a view of the apparatus of FIG. 5 illustrating the use thereof.

FIG. 5 is an end view of rifle rest apparatus 100, which is substantially the same as rifle rest apparatus 10 of FIGS. 1–4, with an alternate adjustment means illustrated. The rifle rest apparatus 100 includes a block 112, substantially the same size as block 12 of FIGS. 1–4, and a pair of notches 114 and 116 extending into the block 112. The notches 114 and 116 correspond to the notches 14 and 16 of FIGS. 1–4. The block 112 may be appropriately covered, substantially the same as block 12. The covering is not shown, for purposes of clarity, in FIGS. 5, 6, and 7. However, friction means 126 is shown in FIGS. 5 and 6, and it corresponds to the friction means 26 of FIGS. 1–4. The friction means or material 126 is disposed on the side of the block 112 opposite from the notches 114 and 116. On an end 120 of the block 112 is disposed adjustment means 80. The adjustment means 80 includes a plate 82 appropriately secured to the end 120 of the block 112 by fasteners, such as screws 83. The plate 82 includes a slot 84 extending through the plate. One end of the plate is disposed adjacent side 113 of the block 112, and the opposite end of the plate 82 is disposed adjacent side 115 of the block. Side 113 is opposite notch 116, and side 115 is opposite notch 114.

A bracket 86 is pivotally movable along slot 84 so that it may be oriented either adjacent side 115 of the block 112, or along side 113 of the block 112. In FIG. 5, the bracket 86 is oriented adjacent side 115. The bracket is held in place by a screw 88 which extends through the bracket 86 and into a tapped hole in the plate 82. For receiving the screw 88, the plate includes a pair of tapped holes 90 and 91 (See also FIG. 6), each of which is disposed adjacent one end of the slot 84 and adjacent the respective sides 113 and 115 of the block 112.

The bracket 86 also includes a tapped hole which receives a threaded screw 92 and which is adjustably screwed in the bracket to raise or lower the end 120 of the block 112. The screw 92 includes a narrow knob 94 on the top of the screw, and a foot 96 on the bottom or lower portion of the screw. The screw 92, with its narrow knob 94 and foot 96, is substantially identical to the screw 38 illustrated in detail in FIG. 4.

FIG. 6 is a view of the rifle rest apparatus 110 of FIG. 5 showing the block 112 oriented 90° from that shown in FIG. 5, with side 113 down, and thus with notch 116 extending upwardly on the block. The notch 114, opposite the side 115, is shown in a sideward orientation.

The adjustment means 80 is illustrated with the bracket 86 moved from adjacent side 115, as shown in FIG. 5, to the position adjacent side 113. The bracket is now held in place adjacent the side 113 by the screw 88 received in the tapped hole 90 (See also FIG. 5) in plate 82. The bracket 86 has been moved along slot 84 from the orientation shown in FIG. 5 to that shown in FIG. 6.

Figure 7:
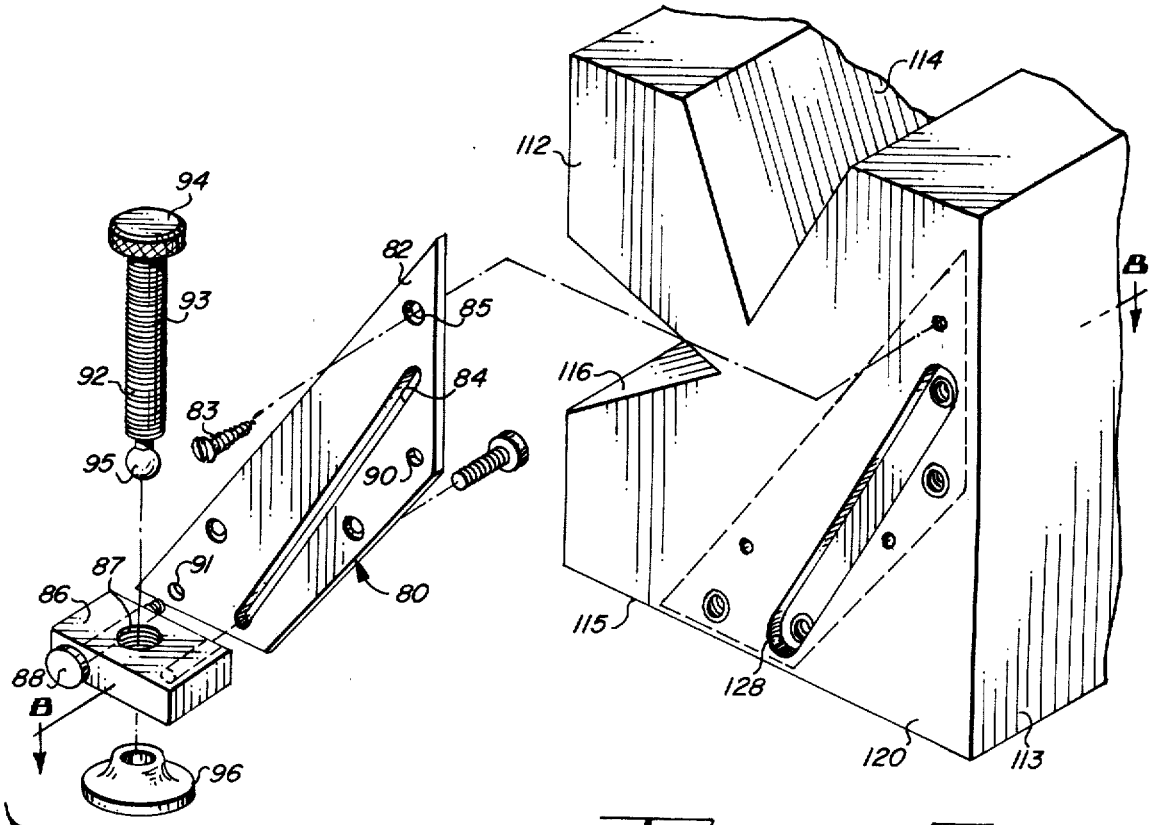
FIG. 7 is a view of the apparatus of FIGS. 5 and 6 with the adjustment means enlarged and exploded illustrating the cooperation among the various elements thereof.

FIG. 7 is an enlarged view of the apparatus of FIGS. 5 and 6, showing the adjustment means 80 broken away and exploded from the block 112. The block 112 is shown with its respective notches 114 and 116 oriented with the notch 114 upwardly. Accordingly, the block is shown in the orientation similar to FIG. 5, with the block disposed on side 115. Side 113, opposite notch 116, is shown. Also shown in phantom in FIG. 7 is the outline of plate 82 on the block. A groove 128 is shown extending downwardly from the front 120 of the block 112 beneath where the plate 82 is secured.

The adjustment means 80 is separated from the block 112 and the component parts are shown exploded therefrom. The plate 82 has been moved outwardly from the end 120 of the block 112, and is shown in the orientation directly away from that outlined in phantom on the end 120 of the block. The slot 84 is shown and in the assembled position, with the plate 82 secured by the screws 83 to the block 112, the slot 84 overlays substantially parallel to the groove 128 in the block. The tappped holes 90 and 91 are also shown extending through the plate 82. The tapped holes 90 and 91 receive the screw 88 to lock the bracket 86 against the plate 82, depending on the orientation of the bracket. (See FIGS. 5 and 6). The screw 88 extends through the bracket 86. Appropriate beveled holes 85 are shown extending through the plate 82 to receive the screws 83 to hold the plate 82 against the block 112.

The threaded shank 93 of the screw 92 extends through a tapped hole or aperture 87 which extends through the bracket 86. The screw 92 includes a narrow knob at the top thereof, and a foot 96 at the bottom thereof. The foot is secured to the screw 92 about a ball 95 which is on the opposite end of the threaded shank 93 of the screw 92 from the narrow knob 94. The foot is appropriately secured to the ball 95 substantially the same as in the comparable apparatus of FIGS. 1–4, illustrated in detail in FIG. 4.

Figure 8:
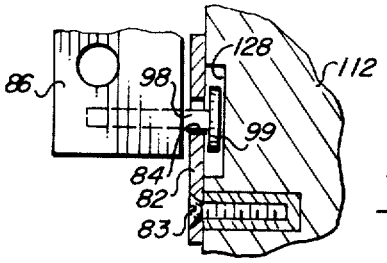
FIG. 8 is a fragmentary view in partial section of a portion of the apparatus of FIG. 7 taken generally along line 8—8 of FIG. 7.

FIG. 8 is an enlarged view of a portion of the apparatus of FIGS. 5 and 6, showing in enlarged detail the cooperation between the bracket 86 and the slot 84 in the plate 82. The plate 82 is shown secured to the block 112 as by screws 83. The bracket 86 is shown with a guide pin 98 secured to the bracket 86 and extending from the bracket into the groove 128 beneath the plate 82. The pin 98 is preferably threaded into the bracket 86, with a portion thereof, head 99, extending beneath the plate 82 into the groove 128 of the block 112. The diameter of the head 99 is greater than the width of the slot 84 and accordingly as the bracket is moved, the bracket will be guided and held within the slot 84. Thus the pin 98, with its head 99, comprises a guide for the bracket 86 and the bracket is actually secured in place by the screw 88 in the respective tapped hole, either hole 90 or hole 91.

While the principles of the invention have been made clear in illustrative embodiments, there will be immediately obvious to those skillled in the art many modifications of structure, arrangement, proportions, the elements, materials, and components used in the practice of the invention, and otherwise, which are particularly adapted for specific environments and operating requirements, without departing from those principles. Obviously, also, the rifle rest apparatus, since it supports the entire weight of a rifle, may be used as a rifle rack for holding and displaying a rifle. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Rifle rest apparatus, comprising, in combination:
block means;
groove means extending into the block means along the length of the block means for receiving a portion of a rifle and for supporting the rifle; and
means for adjusting the elevation of a portion of the block means, including a bracket secured to an end of the block means and adjustable screw means extending through said bracket.

2. The apparatus of claim 1 in which the groove means includes a pair of vee-shaped grooves extending into the block means, on each along adjacent sides of the block means.

3. The apparatus of claim 2 in which the means for adjusting the elevation of a portion of the block means includes a pair of brackets, each secured adjacent a side of an end of the block means, and an adjustable screw extending through each bracket.

4. Rifle rest apparatus, comprising, in combination:
block means having a generally rectangular configuration;
groove means extending into the block means for receiving a portion of a rifle; and
means for adjusting the elevation of a portion of the block means, including
a plate secured to an end of the block means extending between a pair of adjacent sides of the block means,
a slot in said plate,
a bracket movable in the slot in the plate and secureable thereto, and
an adjustable screw extending through the bracket.

5. The apparatus of claim 4 in which the block means includes a groove in an end of the block means and the plate is secured to the end of the block means with the slot in the plate disposed substantially parallel and overlying the groove.

6. The apparatus of claim 5 in which the groove means includes a pair of grooves extending into the block means on adjacent sides of the block means.

* * * * *

UNITED STATES PATENT OFFICE

CERTIFICATE OF CORRECTION

Patent No. 3,935,657 Dated February 6, 1976

Inventor(s) Virdell H. Wade

It is certified that error appears in the above-identified patent and that said Letters Patent are hereby corrected as shown below:

On the Title page, in item [45], the issue date "Feb. 3, 1975" should read -- Feb. 3, 1976 --.

Signed and Sealed this twentieth Day of April 1976

[SEAL]

Attest:

RUTH C. MASON
*Attesting Officer*

C. MARSHALL DANN
*Commissioner of Patents and Trademarks*